US012448669B2

(12) United States Patent
Li et al.

(10) Patent No.: US 12,448,669 B2
(45) Date of Patent: Oct. 21, 2025

(54) DIE-CAST ALUMINUM ALLOY AND PREPARATION METHOD AND USE THEREOF

(71) Applicant: BYD COMPANY LIMITED, Shenzhen (CN)

(72) Inventors: Yunchun Li, Shenzhen (CN); Qiang Guo, Shenzhen (CN); Youping Ren, Shenzhen (CN); Yongliang Xie, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 658 days.

(21) Appl. No.: 17/600,267

(22) PCT Filed: Mar. 26, 2020

(86) PCT No.: PCT/CN2020/081413
§ 371 (c)(1),
(2) Date: Sep. 30, 2021

(87) PCT Pub. No.: WO2020/207259
PCT Pub. Date: Oct. 15, 2020

(65) Prior Publication Data

US 2022/0195563 A1 Jun. 23, 2022

(30) Foreign Application Priority Data

Apr. 12, 2019 (CN) ..... 201910293278.5

(51) Int. Cl.
*C22C 21/08* (2006.01)
*B22D 21/00* (2006.01)
*B22D 21/04* (2006.01)
*C22C 1/02* (2006.01)
*C22F 1/047* (2006.01)

(52) U.S. Cl.
CPC ..... *C22C 21/08* (2013.01); *B22D 21/007* (2013.01); *B22D 21/04* (2013.01); *C22C 1/026* (2013.01); *C22F 1/047* (2013.01)

(58) Field of Classification Search
CPC ..... C22C 21/08; C22C 1/026; B22D 21/007; B22D 21/04; C22F 1/047
USPC ..... 420/544
See application file for complete search history.

(56) References Cited

U.S. PATENT DOCUMENTS

2019/0136350 A1* 5/2019 Wiesner ..... C22C 21/08

FOREIGN PATENT DOCUMENTS

| | | | |
|---|---|---|---|
| CA | 2249762 | A1 | 4/1999 |
| CN | 1203956 | A | 1/1999 |
| CN | 1555423 | A | 12/2004 |
| CN | 100999797 | A | 7/2007 |

(Continued)

OTHER PUBLICATIONS

CN101445879A Translation (Year: 2009).*

(Continued)

*Primary Examiner* — Danielle M. Carda
(74) *Attorney, Agent, or Firm* — Wenye Tan

(57) ABSTRACT

A die-cast aluminum alloy and a preparation method and use thereof are disclosed. Based on the total mass of the die-cast aluminum alloy, the die-cast aluminum alloy includes: 4-9 wt % of Mg; 1.6-2.8 wt % of Si; 1.1-2 wt % of Zn; wt % of Mn; 0.1-0.3 wt % of Ti; 0.009-0.05 wt % of Be; the balance of Al; and less than 0.2 wt % of inevitable impurities.

9 Claims, 1 Drawing Sheet

(56) References Cited

FOREIGN PATENT DOCUMENTS

| | | | | | |
|---|---|---|---|---|---|
| CN | 101445879 | A | * | 6/2009 | |
| CN | 102796925 | A | | 11/2012 | |
| CN | 103031473 | A | * | 4/2013 | |
| CN | 103343268 | A | | 10/2013 | |
| CN | 104694799 | A | | 6/2015 | |
| CN | 104862552 | A | | 8/2015 | |
| CN | 105088019 | A | | 11/2015 | |
| CN | 105734365 | A | | 7/2016 | |
| CN | 106801171 | A | | 6/2017 | |
| CN | 107208198 | A | | 9/2017 | |
| CN | 107312955 | A | | 11/2017 | |
| CN | 109072356 | A | * | 12/2018 | ..... B22D 21/007 |
| CN | 110093541 | A | | 8/2019 | |
| EP | 1138794 | A | | 10/2001 | |
| EP | 1138794 | A1 | | 10/2001 | |
| EP | 1167560 | A1 | | 1/2002 | |
| EP | 3159422 | A1 | | 4/2017 | |
| GB | 605095 | A | | 7/1948 | |
| GB | 2500825 | A | | 10/2013 | |
| JP | S62222039 | A | | 9/1987 | |
| JP | H01247549 | A | | 10/1989 | |
| WO | 2005047554 | A1 | | 5/2005 | |
| WO | WO-2016034857 | A1 | * | 3/2016 | ..... C22C 1/026 |

OTHER PUBLICATIONS

CN103031473A Translation (Year: 2013).*

The World Intellectual Property Organization (WIPO) International Search Report for PCT/CN2020/081413 Jun. 3, 2020 4 pages (with translation).

* cited by examiner

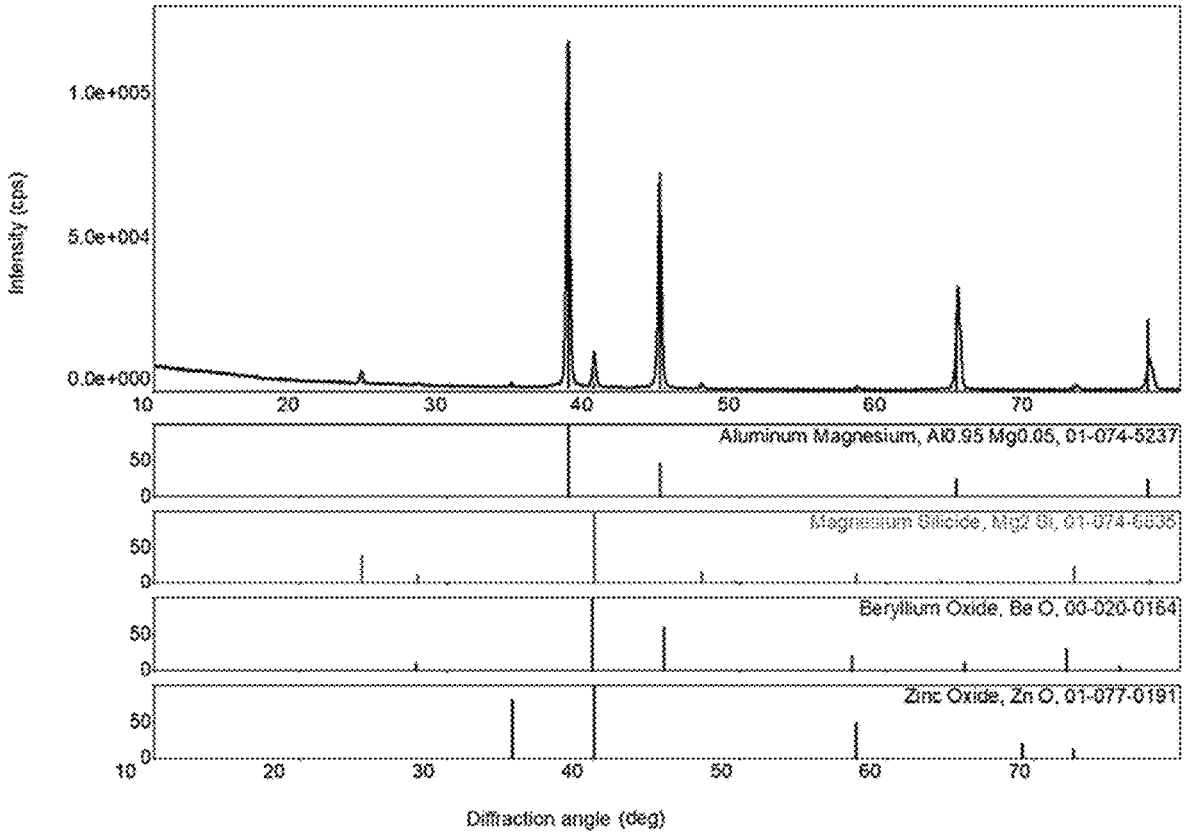
Intensity (cps)
1.0e+005
5.0e+004
0.0e+000
10
20
30
40
50
60
70
Aluminum Magnesium, Al0.95 Mg0.05, 01-074-5237
Magnesium Silicide, Mg2 Si, 01-074-6035
Beryllium Oxide, Be O, 00-020-0164
Zinc Oxide, Zn O, 01-077-0191
50
0
Diffraction angle (deg)

DIE-CAST ALUMINUM ALLOY AND PREPARATION METHOD AND USE THEREOF

CROSS-REFERENCE TO RELATED APPLICATIONS

This application is a national phase entry under 35 U.S.C. § 371 of International Application No. PCT/CN2020/081413, filed on Mar. 26, 2020, which claims priority to Chinese Patent Application No. 201910293278.5 filed by the BYD Co., Ltd. on Apr. 12, 2019, and entitled DIE-CAST ALUMINUM ALLOY AND PREPARATION METHOD AND USE THEREOF, the entire contents of all of which are incorporated herein by reference in their entirety.

FIELD

The present disclosure relates to the field of aluminum alloys, and in particular, to a die-cast aluminum alloy and a preparation method and use thereof.

BACKGROUND

Al—Mg alloys for die casting have been approved by customers due to good mechanical properties and corrosion resistance thereof. However, magnesium is relatively active and is easily oxidized and burnt during casting. The oxidized and burnt residue entering the product affects the mechanical properties of the alloy, resulting in large fluctuation and poor stability in product performance, and cracking in the subsequent preparation of an alloy die casting. Therefore, the Al—Mg alloys for die casting are subject to certain restrictions in use. Specifically, for example, the ADC6 aluminum alloy is easily oxidized and burnt to cause slagging during casting, which affects the comprehensive performance of the product and limits the scope of application of the product.

SUMMARY

To overcome the defects in the related art, this disclosure provides a die-cast aluminum alloy and a preparation method thereof. The die-cast aluminum alloy has good mechanical properties, stability, and die-casting formability.

According to a first aspect of this disclosure, a die-cast aluminum alloy is provided. Based on the total mass of the die-cast aluminum alloy, the die-cast aluminum alloy includes: 4-9 wt % of Mg; 1.6-2.8 wt % of Si; 1.1-2 wt % of Zn; 0.5-1.5 wt % of Mn; 0.1-0.3 wt % of Ti; 0.009-0.05 wt % of Be; the balance of Al; and less than 0.2 wt % of inevitable impurities.

According to an embodiment of this disclosure, based on the total mass of the die-cast aluminum alloy, the die-cast aluminum alloy includes: 5-7 wt % of Mg; 1.6-2.5 wt % of Si; 1.1-1.4 wt % of Zn; 0.6-1.0 wt % of Mn; 0.1-0.3 wt % of Ti; 0.01-0.022 wt % of Be; the balance of Al; and less than 0.2 wt % of inevitable impurities.

According to an embodiment of this disclosure, in the die-cast aluminum alloy, the mass ratio of Zn to Be is (60-140):1.

According to an embodiment of this disclosure, in the die-cast aluminum alloy, the mass ratio of Mg to Zn is (4.5-5):1, and the mass ratio of Si to Zn is (1.5-2):1.

According to an embodiment of this disclosure, based on the total mass of the die-cast aluminum alloy, among the inevitable impurities, the content of each of the Cu, Ni, Cr, Zr, Ag, Sr, and Sn impurities is independently less than 0.1%, and the content of Fe is less than 0.15%.

According to an embodiment of this disclosure, the die-cast aluminum alloy includes a $Mg_2Si$ phase, a $MgZn_2$ phase, an $Al_6Mn$ phase, and a $TiAl_2$ phase.

According to an embodiment of this disclosure, for the die-cast aluminum alloy, the tensile strength is not less than 350 MPa, the elongation is not less than 4%, and the relative standard deviation of the tensile strength is not greater than 10%.

According to an embodiment of this disclosure, for the die-cast aluminum alloy, the tensile strength is 350-390 MPa, the elongation is 6-9%, and the relative standard deviation of the tensile strength is 5-8%.

According to a second aspect of this disclosure, a method for preparing the foregoing die-cast aluminum alloy is provided, including: smelting an aluminum-containing material in a smelting furnace, adding a silicon-containing material, a manganese-containing material, a zinc-containing material, a magnesium-containing material, a beryllium-containing material, and a titanium-containing material for smelting after the aluminum-containing material is melted, subjecting the mixed materials to refining and degassing and then casting to obtain an aluminum alloy ingot, and melting and die-casting the aluminum alloy ingot, to obtain the die-cast aluminum alloy according to the first aspect of this disclosure.

In some embodiments, the smelting temperature of the aluminum-containing material is 710-730° C., and the smelting temperature of the silicon-containing material, the manganese-containing material, the zinc-containing material, the magnesium-containing material, the beryllium-containing material, and the titanium-containing material is 680-710° C.

According to a third aspect of this disclosure, use of the die-cast aluminum alloy of this disclosure or a die-cast aluminum alloy obtained by using the method in computers, communication electronic products, or consumer electronic products.

Through the foregoing technical solutions, the die-cast aluminum alloy provided by this disclosure contains the foregoing components with limited contents, which can have good mechanical properties, stability, and die-casting formability.

Additional aspects and advantages of this disclosure will be given in the following description, some of which will become apparent from the following description or may be learned from practices of this disclosure.

BRIEF DESCRIPTION OF THE DRAWINGS

The foregoing additional aspects and advantages of this disclosure will become apparent and comprehensible from the following descriptions of the embodiments with reference to the accompanying drawings.

FIG. 1 is an XRD pattern of a die-cast aluminum alloy obtained from Example 1.

DETAILED DESCRIPTION

The endpoints and any values of the ranges disclosed herein are not limited to the precise range or value, and such ranges or values should be understood to include values that are close to the ranges or values. For numerical ranges, the endpoint values of the various ranges, the endpoint values of the various ranges and the individual point values, and the individual point values can be combined with one another to yield one or more new numerical ranges, and these numerical ranges should be considered as specifically disclosed herein.

According to a first aspect of this disclosure, a die-cast aluminum alloy is provided. Based on the total mass of the die-cast aluminum alloy, the die-cast aluminum alloy includes: 4-9 wt % of Mg; 1.6-2.8 wt % of Si; 1.1-2 wt % of Zn; 0.5-1.5 wt % of Mn; 0.1-0.3 wt % of Ti; 0.009-0.05 wt % of Be; the balance of Al; and less than 0.2 wt % of inevitable impurities. For example, the content of Mg is 4 wt %, 4.1 wt %, . . . , 8.9 wt %, or 9 wt %; the content of Si is 1.6 wt %, 1.7 wt %, . . . , 2.7 wt %, or 2.8 wt %; the content of Zn is 1.1 wt %, 1.2 wt %, . . . , 1.9 wt %, or 2 wt %; the content of Mn is 0.5 wt %, 0.6 wt %, . . . , 1.4 wt %, or 1.5 wt %; the content of Ti is 0.1 wt %, 0.11 wt %, . . . , 0.29 wt %, or 0.3 wt %; and the content of Be is 0.009 wt %, 0.01 wt %, 0.049 wt %, or 0.05 wt %.

The die-cast aluminum alloy provided by this disclosure has good mechanical properties, stability, and die-casting formability. This is because the cooperation between elements Mg, Si, Zn, Mn, Ti, and Be with specific contents in this disclosure balances various properties of the alloy, thereby obtaining the die-cast aluminum alloy with excellent comprehensive performance.

According to an embodiment of this disclosure, in the die-cast aluminum alloy, the content of Mg in percentage by mass is 5-7%. According to a specific embodiment of this disclosure, in the die-cast aluminum alloy, the content of Mg in percentage by mass is 6%.

According to an embodiment of this disclosure, in the die-cast aluminum alloy, the content of Si in percentage by mass is 1.6-2.5%. According to a specific embodiment of this disclosure, in the die-cast aluminum alloy, the content of Si in percentage by mass is 1.7-2.4%. According to another specific embodiment of this disclosure, in the die-cast aluminum alloy, the content of Si in percentage by mass is 2.2%.

According to an embodiment of this disclosure, in the die-cast aluminum alloy, the content of Zn in percentage by mass is 1.1-1.4%. According to a specific embodiment of this disclosure, in the die-cast aluminum alloy, the content of Zn in percentage by mass is 1.2%.

According to an embodiment of this disclosure, in the die-cast aluminum alloy, the content of Mn in percentage by mass is 0.6-1.0%. According to a specific embodiment of this disclosure, in the die-cast aluminum alloy, the content of Mn in percentage by mass is 0.7%.

According to an embodiment of this disclosure, in the die-cast aluminum alloy, the content of Ti in percentage by mass is 0.1-0.25%. According to a specific embodiment of this disclosure, in the die-cast aluminum alloy, the content of Ti in percentage by mass is 0.15%.

According to an embodiment of this disclosure, in the die-cast aluminum alloy, the content of Be in percentage by mass is 0.01-0.022%. According to a specific embodiment of this disclosure, in the die-cast aluminum alloy, the content of Be in percentage by mass is 0.015%.

To further improve the mechanical properties, stability, and die-casting formability of the die-cast aluminum alloy, in an embodiment of this disclosure, based on the total mass of the die-cast aluminum alloy, the die-cast aluminum alloy includes: 5-7 wt % of Mg; 1.6-2.5 wt % of Si; 1.1-1.4 wt % of Zn; 0.6-1.0 wt % of Mn; 0.1-0.3 wt % of Ti; 0.01-0.022 wt % of Be; the balance of Al; and less than 0.2 wt % of inevitable impurities.

In this disclosure, the die-cast aluminum alloy contains Mg, Si, and Zn within the foregoing content ranges, which can achieve a good solid solution strengthening effect, and Mg can be combined with Si and Zn to form the $Mg_2Si$ phase and the $MgZn_2$ phase to achieve a precipitation strengthening effect, which ensures the toughness (the toughness refers to that the alloy has both good tensile strength and elongation) of the alloy product. In the die-cast aluminum alloy of this disclosure, if the content of Mg or Si is excessively low, the toughening effect of the alloy cannot be ensured, and the mechanical properties are poor; if the content of Mg is excessively high, the alloy is easily oxidized to cause slagging, and the plasticity and toughness of the alloy decrease; and if the content of Si is excessively high, the alloy is likely to precipitate a brittle elemental silicon phase, which also causes the plasticity and toughness of the alloy to decrease. In addition, it can be seen from FIG. 1 that the die-cast aluminum alloy of this disclosure contains zinc oxide, and Zn forms an oxide film on the surface of an aluminum-magnesium alloy melt to prevent the melt from oxidation quickly. In the die-cast aluminum alloy of this disclosure, if the content of Zn is excessively low, the protection for the allot melt against oxidation is weakened, the melt slag increases, the fluctuation of the mechanical properties increases, the stability of the product is poor, and the mechanical properties of the alloy are poor; and if the content of Zn is excessively high, the alloy is likely to precipitate a brittle phase with a low melting point, the plasticity is reduced, and the toughness of the alloy is reduced.

In this disclosure, a melt refers to a state in which a substance that was originally a solid at room temperature becomes a liquid at a high temperature. Specifically, in this disclosure, the melt refers to that the metal raw material is melted into a molten state (liquid) in the process of preparing the die-cast aluminum alloy.

In this disclosure, the die-cast aluminum alloy contains Be within the foregoing content ranges, which can form an oxide film on the surface of an aluminum-magnesium alloy melt to prevent the melt from oxidation quickly and reduce slagging caused by oxidation of the melt. It can be seen from FIG. 1 that the die-cast aluminum alloy of this disclosure obviously contains beryllium oxide. In the aluminum alloy of this disclosure, if the content of Be is excessively low, the protection for the allot melt against oxidation is weakened, the melt slag increases, and the fluctuation of the mechanical properties increases; and if the content of Be is excessively high, coarse grains are likely to be formed, the plasticity is reduced, and the toughness of the alloy is reduced.

In this disclosure, the die-cast aluminum alloy contains Mn within the foregoing content ranges, which can be combined with Al to form the $Al_6Mn$ phase to achieve a precipitation strengthening effect, further increasing the toughness of the alloy product, and Mn within the foregoing content ranges can alleviate die erosion during die-casting production and increase die life. In the aluminum alloy of this disclosure, if the content of Mn is excessively low, the toughening effect of the alloy is reduced, the mechanical properties are reduced, and die life is reduced; and if the content of Mn is excessively high, it is easy to precipitate a brittle phase, the plasticity is reduced, and the toughness of the alloy is reduced.

In this disclosure, the die-cast aluminum alloy contains Ti within the foregoing content ranges, which can be combined with Al to form the $TiAl_2$ phase to achieve a grain refining effect, further increasing the toughness of the alloy product. In the aluminum alloy of this disclosure, if the content of Ti is excessively low, the grain refining and toughening effect of the alloy is reduced; and if the content of Ti is excessively high, a coarse brittle phase is likely to segregate, the plasticity is reduced, and the toughness of the alloy is reduced.

According to an embodiment of this disclosure, in the die-cast aluminum alloy, the mass ratio of Zn to Be is (60-140):1. For example, in the die-cast aluminum alloy, the mass ratio of Zn to Be is 60:1, 61:1, 139:1, or 140:1. In some embodiments, by conducting a large quantity of experiments that Zn and Be in the die-cast aluminum alloy that meet the foregoing ratio relationship can form a dense oxide film on the surface of an aluminum alloy (especially an aluminum-magnesium alloy) melt to better protect the melt from oxidation, resulting in reduced oxidation of the aluminum alloy melt, reduced slagging, and improved performance and stability of the die-cast product. The aluminum-magnesium alloy belongs to the system with severe oxidation slagging in the aluminum alloy. This disclosure can significantly reduce slagging in the alloy melt by properly adding Zn and Be with controlled addition amounts.

According to an embodiment of this disclosure, in the die-cast aluminum alloy, the mass ratio of Mg to Zn is (4.5-5):1, and the mass ratio of Si to Zn is (1.5-2):1. For example, in the die-cast aluminum alloy, the mass ratio of Mg to Zn is 4.5:1, 4.6:1, . . . , 4.9:1, or 5:1, and the mass ratio of Si to Zn is 1.5:1, 1.6:1, . . . , 1.9:1, or 2:1. Mg is easily combined with Zn and Si to form the $Mg_2Si$ phase and the $MgZn_2$ phase to achieve a strengthening effect. In some embodiments, by conducting a large quantity of experiments that, when Mg, Zn, and Si in the die-cast aluminum alloy meet the foregoing ratio relationship, Mg can fully interact with Zn and Si to form precipitation strengthening phases, and excess Mg can further achieve a solid solution strengthening effect in the aluminum alloy matrix. Therefore, the die-cast aluminum alloy of this disclosure has a better toughness.

According to this disclosure, there are a small quantity of other metal elements in the die-cast aluminum alloy, including one, two, three, or more of Fe, Cu, Ni, Cr, Zr, Ag, Sr, and Sn, and the other metal elements are generally from impurities in the alloy raw material during the preparation of the alloy. Excessive impurity elements are likely to lead to a decrease in the elongation of the die-casting alloy and product cracking. Therefore, based on the total mass of the die-cast aluminum alloy, in the die-cast aluminum alloy of this disclosure, the content of impurity Fe is less than 0.15%, and the content of each of the Cu, Ni, Cr, Zr, Ag, Sr, and Sn impurities is independently less than 0.1%. According to a specific embodiment of this disclosure, based on the total mass of the die-cast aluminum alloy, in the die-cast aluminum alloy of this disclosure, the content of each of the Cu, Ni, Cr, Zr, Ag, Sr, and Sn impurities is independently less than 0.02%.

According to an embodiment of this disclosure, the die-cast aluminum alloy includes a $Mg_2Si$ phase, a $MgZn_2$ phase, an $Al_6Mn$ phase, and a $TiAl_2$ phase. This disclosure contains the foregoing crystal phases, which can effectively increase the mechanical properties of the alloy.

According to an embodiment of this disclosure, for the die-cast aluminum alloy, the tensile strength is not less than 350 MPa, the elongation is not less than 4%, and the relative standard deviation of the tensile strength is not greater than 10%. In this disclosure, the relative standard deviation is the value obtained by dividing a standard deviation by a corresponding average value and multiplying 100%. The relative standard deviation can reflect the stability of product performance. The smaller the relative standard deviation is, the more stable the product performance is. According to a specific embodiment of this disclosure, for the die-cast aluminum alloy, the tensile strength is 350-390 MPa, the elongation is 6-9%, and the relative standard deviation of the tensile strength is 5-8%.

According to a second aspect of this disclosure, a method for preparing the foregoing die-cast aluminum alloy is provided, including the following steps: according to the foregoing composition ratio of the die-cast aluminum alloy, first smelting an aluminum-containing material in a smelting furnace, adding a silicon-containing material, a manganese-containing material, a zinc-containing material, a magnesium-containing material, a beryllium-containing material, and a titanium-containing material for smelting after the aluminum-containing material is melted, subjecting the mixed materials to refining and degassing and then casting to obtain an aluminum alloy ingot, and melting and die-casting the aluminum alloy ingot, to obtain the die-cast aluminum alloy according to the first aspect of this disclosure.

In this disclosure, the aluminum-containing material, the magnesium-containing material, the silicon-containing material, the zinc-containing material, the manganese-containing material, the titanium-containing material, and the beryllium-containing material may be materials that can provide various elements required for preparing the die-cast aluminum alloy of this disclosure, or may be alloys or pure metals containing the foregoing elements, as long as the composition of the aluminum alloy obtained after the added aluminum alloy raw material is smelted is within the foregoing range. According to a specific embodiment of this disclosure, the aluminum alloy raw material may include a pure Al or Al alloy, a pure Mg or Mg alloy, a pure Si or Si alloy, a pure Zn or Zn alloy, a pure Mn or Mn alloy, a pure Ti or Ti alloy, and a pure Be or Be alloy. According to another specific embodiment of this disclosure, the aluminum alloy raw material includes a pure Al, a pure Mg, an Al—Si alloy, a pure Zn, an Al—Mn alloy, an Al—Ti alloy, and an Al—Be alloy.

According to the method for preparing the die-cast aluminum alloy in this disclosure, the smelting condition is 700-750° C. of the smelting temperature. According to a specific embodiment of this disclosure, the smelting temperature of the aluminum-containing material is 710-730° C., such as 710° C., 711° C., . . . , 729° C., or 730° C.; and the smelting temperature of the silicon-containing material, the manganese-containing material, the zinc-containing material, the magnesium-containing material, the beryllium-containing material, and the titanium-containing material is 680-710° C., such as 680° C., 681° C., . . . , 709° C., or 710° C.

According to the method for preparing the die-cast aluminum alloy in this disclosure, the refining includes adding a refining agent into the molten metal and stirring to implement refining and degassing, the refining agent is at least one of hexachloroethane, zinc chloride, manganese chloride, and potassium chloride, and the refining temperature is 720-740° C., such as 720° C., 721° C., . . . , 739° C., or 740° C.

According to the method for preparing the die-cast aluminum alloy in this disclosure, the casting temperature is 680-720° C., such as 680° C., 681° C., . . . , 719° C., or 720° C.

According to the method for preparing the die-cast aluminum alloy in this disclosure, the die-casting is to remelt the aluminum alloy ingot at 680-720° C. (such as 680° C., 681° C., . . . , 719° C., or 720° C.) into an aluminum alloy liquid, pour a certain amount of the aluminum alloy liquid into a pressure chamber of a die-casting machine, and then inject the aluminum alloy liquid into a metal die by using an injection hammer to form a product.

According to a third aspect of this disclosure, use of the die-cast aluminum alloy of this disclosure or a die-cast aluminum alloy prepared by using the method of this disclosure in computers, communication electronic products, or consumer electronic products. According to an embodiment of this disclosure, the die-cast aluminum alloy of this disclosure is used in housings of 3C electronic products.

This disclosure is described with reference to the following specific examples. It is to be noted that these examples are merely illustrative and are not intended to limit this disclosure in any way.

Examples 1-52

An alloy raw material containing various elements was prepared according to the aluminum alloy composition shown in Table 1. A pure Al was put into a smelting furnace and smelted at 710-730° C. After the pure Al was melted, an Al—Si alloy, an Al—Mn alloy, a pure Zn, a pure Mg, an Al—Be alloy, and an Al—Ti alloy were added and smelted at 680-710° C., and stirred uniformly, to obtain a molten metal.

At 720-740° C., a refining agent was added into the molten metal for refining and degassing until the refining agent is fully reacted, then slag was removed to obtain an alloy liquid, and then the alloy liquid was cast to obtain an aluminum alloy ingot. The aluminum alloy ingot was remelted at 680-720° C. into an aluminum alloy liquid, a certain amount of the aluminum alloy liquid was poured into a pressure chamber of a die-casting machine, and then the aluminum alloy liquid was injected into a metal die by using an injection hammer to form a product, to obtain a die-cast aluminum alloy. The test result was shown in Table 2.

Comparative Examples 1-19

A die-cast aluminum alloy was prepared by using the same method as in the foregoing examples, except that an aluminum alloy raw material was prepared according to the composition shown in Table 1. The test result was shown in Table 2.

Performance Test

Aluminum alloy tensile test: Tensile test bars (diameter 6.4 mm, gauge length 50 mm) with different compositions were obtained by die-casting, the tensile test was carried out by using an electronic universal testing machine (model: CMT5105) according to GBT 228.1-2010 with a gauge length of 50 mm and a loading rate of 2 mm/min, and test data (tensile strength and elongation) was recorded. Six test bars were tested for each composition. The tensile strength and the elongation were average values of the six data. The relative standard deviation of the tensile strength was a ratio in percentage of a standard deviation of six tensile strength data to an average value.

Die-casting formability test: Aluminum alloys with different compositions were die-cast, if the composition had good fluidity and could easily fill up the cavity, and there was less slag on the surface of the melt, then the die-casting formability was evaluated as excellent; if the composition had average fluidity and required a relatively high pressure and speed to fill up the cavity, and there was less slag on the surface of the melt, then the die-casting formability was evaluated as good; and if the composition had average fluidity and required a relatively high pressure and speed to fill up the cavity, and there was much slag on the surface of the melt, then the die-casting formability was evaluated as poor.

TABLE 1

| | Mg | Si | Zn | Mn | Ti | Be | Fe | Cu | Ni | Inevitable impurities and Al | $m_{Zn}/m_{Be}$ | $m_{Mg}/m_{Zn}$ | $m_{Si}/m_{Zn}$ |
|---|---|---|---|---|---|---|---|---|---|---|---|---|---|
| Example 1 | 5 | 2.20 | 1.1 | 0.75 | 0.2 | 0.015 | — | — | — | 90.74 | 73.3 | 4.55 | 2.00 |
| Example 2 | 5.5 | 2.20 | 1.1 | 0.75 | 0.2 | 0.015 | — | — | — | 90.24 | 73.3 | 5.00 | 2.00 |
| Example 3 | 5 | 1.65 | 1.1 | 0.75 | 0.2 | 0.015 | — | — | — | 91.29 | 73.3 | 4.55 | 1.50 |
| Example 4 | 5 | 1.80 | 1.1 | 0.75 | 0.2 | 0.015 | — | — | — | 91.14 | 73.3 | 4.55 | 1.64 |
| Example 5 | 5 | 2.00 | 1.1 | 0.75 | 0.2 | 0.015 | — | — | — | 90.94 | 73.3 | 4.55 | 1.82 |
| Example 6 | 4 | 2.20 | 1.1 | 0.75 | 0.2 | 0.015 | — | — | — | 91.74 | 73.3 | 3.64 | 2.00 |
| Example 7 | 9 | 2.20 | 1.1 | 0.75 | 0.2 | 0.015 | — | — | — | 86.74 | 73.3 | 8.18 | 2.00 |
| Example 8 | 5 | 2.60 | 1.1 | 0.75 | 0.2 | 0.015 | — | — | — | 90.34 | 73.3 | 4.55 | 2.36 |
| Example 9 | 5 | 2.80 | 1.1 | 0.75 | 0.2 | 0.015 | — | — | — | 90.14 | 73.3 | 4.55 | 2.55 |
| Example 10 | 6 | 1.80 | 1.2 | 0.75 | 0.2 | 0.01 | — | — | — | 90.04 | 120.0 | 5.00 | 1.50 |
| Example 11 | 5.5 | 1.80 | 1.2 | 0.75 | 0.2 | 0.01 | — | — | — | 90.54 | 120.0 | 4.58 | 1.50 |
| Example 12 | 6 | 2.00 | 1.2 | 0.75 | 0.2 | 0.01 | — | — | — | 89.84 | 120.0 | 5.00 | 1.67 |
| Example 13 | 6 | 2.30 | 1.2 | 0.75 | 0.2 | 0.01 | — | — | — | 89.54 | 120.0 | 5.00 | 1.92 |
| Example 14 | 6 | 2.40 | 1.2 | 0.75 | 0.2 | 0.01 | — | — | — | 89.44 | 120.0 | 5.00 | 2.00 |
| Example 15 | 6 | 1.80 | 1.1 | 0.75 | 0.2 | 0.01 | — | — | — | 90.14 | 110.0 | 5.45 | 1.64 |
| Example 16 | 4 | 1.80 | 1.2 | 0.75 | 0.2 | 0.01 | — | — | — | 92.04 | 120.0 | 3.33 | 1.50 |
| Example 17 | 9 | 1.80 | 1.2 | 0.75 | 0.2 | 0.01 | — | — | — | 87.04 | 120.0 | 7.50 | 1.50 |
| Example 18 | 6 | 2.60 | 1.2 | 0.75 | 0.2 | 0.01 | — | — | — | 89.24 | 120.0 | 5.00 | 2.17 |
| Example 19 | 6 | 2.80 | 1.2 | 0.75 | 0.2 | 0.01 | — | — | — | 89.04 | 120.0 | 5.00 | 2.33 |
| Example 20 | 6 | 1.80 | 1.6 | 0.75 | 0.2 | 0.01 | — | — | — | 89.64 | 160.0 | 3.75 | 1.13 |
| Example 21 | 6 | 1.80 | 1.7 | 0.75 | 0.2 | 0.01 | — | — | — | 89.54 | 170.0 | 3.53 | 1.06 |
| Example 22 | 6.5 | 2.40 | 1.3 | 0.75 | 0.2 | 0.01 | — | — | — | 88.839 | 118.2 | 5.00 | 1.85 |
| Example 23 | 6.0 | 2.40 | 1.3 | 0.75 | 0.2 | 0.011 | — | — | — | 89.339 | 118.2 | 4.62 | 1.85 |
| Example 24 | 6.5 | 2.00 | 1.3 | 0.75 | 0.2 | 0.011 | — | — | — | 89.239 | 118.2 | 5.00 | 1.54 |
| Example 25 | 6.5 | 2.20 | 1.3 | 0.75 | 0.2 | 0.011 | — | — | — | 89.039 | 118.2 | 5.00 | 1.69 |
| Example 26 | 6.5 | 2.50 | 1.3 | 0.75 | 0.2 | 0.011 | — | — | — | 88.739 | 118.2 | 5.00 | 1.92 |
| Example 27 | 6.5 | 2.40 | 1.35 | 0.75 | 0.2 | 0.011 | — | — | — | 88.789 | 122.7 | 4.81 | 1.78 |
| Example 28 | 6.5 | 2.40 | 1.4 | 0.75 | 0.2 | 0.011 | — | — | — | 88.739 | 127.3 | 4.64 | 1.71 |
| Example 29 | 8.0 | 2.40 | 1.3 | 0.75 | 0.2 | 0.011 | — | — | — | 87.339 | 118.2 | 6.15 | 1.85 |
| Example 30 | 6.5 | 2.80 | 1.3 | 0.75 | 0.2 | 0.011 | — | — | — | 88.439 | 118.2 | 5.00 | 2.15 |
| Example 31 | 6.5 | 2.40 | 1.8 | 0.75 | 0.2 | 0.011 | — | — | — | 88.339 | 163.6 | 3.61 | 1.33 |

TABLE 1-continued

| | Mg | Si | Zn | Mn | Ti | Be | Fe | Cu | Ni | Inevitable impurities and Al | $m_{Zn}/m_{Be}$ | $m_{Mg}/m_{Zn}$ | $m_{Si}/m_{Zn}$ |
|---|---|---|---|---|---|---|---|---|---|---|---|---|---|
| Example 32 | 6.5 | 2.40 | 2 | 0.75 | 0.2 | 0.011 | — | — | — | 88.139 | 181.8 | 3.25 | 1.20 |
| Example 33 | 7 | 2.5 | 1.4 | 0.75 | 0.2 | 0.01 | — | — | — | 88.139 | 127.3 | 5.00 | 1.79 |
| Example 34 | 6.5 | 2.5 | 1.4 | 0.75 | 0.2 | 0.011 | — | — | — | 88.639 | 127.3 | 4.64 | 1.79 |
| Example 35 | 7 | 2.4 | 1.4 | 0.75 | 0.2 | 0.011 | — | — | — | 88.239 | 127.3 | 5.00 | 1.71 |
| Example 36 | 7 | 2.3 | 1.4 | 0.75 | 0.2 | 0.011 | — | — | — | 88.339 | 127.3 | 5.00 | 1.64 |
| Example 37 | 8 | 2.5 | 1.4 | 0.75 | 0.2 | 0.011 | — | — | — | 87.139 | 127.3 | 5.71 | 1.79 |
| Example 38 | 9 | 2.5 | 1.4 | 0.75 | 0.2 | 0.011 | — | — | — | 86.139 | 127.3 | 6.43 | 1.79 |
| Example 39 | 7 | 2.5 | 1.6 | 0.75 | 0.2 | 0.011 | — | — | — | 87.939 | 145.5 | 4.38 | 1.56 |
| Example 40 | 7 | 2.5 | 1.8 | 0.75 | 0.2 | 0.011 | — | — | — | 87.739 | 163.6 | 3.89 | 1.39 |
| Example 41 | 7 | 2.5 | 2 | 0.75 | 0.2 | 0.011 | — | — | — | 87.539 | 181.8 | 3.50 | 1.25 |
| Example 42 | 6.0 | 2.0 | 1.3 | 0.75 | 0.2 | 0.01 | — | — | — | 89.739 | 118.2 | 4.62 | 1.54 |
| Example 43 | 6.0 | 2.0 | 1.3 | 0.6 | 0.2 | 0.011 | — | — | — | 89.889 | 118.2 | 4.62 | 1.54 |
| Example 44 | 6.0 | 2.0 | 1.3 | 0.9 | 0.2 | 0.011 | — | — | — | 89.589 | 118.2 | 4.62 | 1.54 |
| Example 45 | 6.0 | 2.0 | 1.3 | 0.75 | 0.1 | 0.011 | — | — | — | 89.839 | 118.2 | 4.62 | 1.54 |
| Example 46 | 6.0 | 2.0 | 1.3 | 0.75 | 0.3 | 0.011 | — | — | — | 89.639 | 118.2 | 4.62 | 1.54 |
| Example 47 | 6.0 | 2.0 | 1.3 | 0.75 | 0.2 | 0.012 | — | — | — | 89.738 | 108.3 | 4.62 | 1.54 |
| Example 48 | 6.0 | 2.0 | 1.3 | 0.75 | 0.2 | 0.015 | — | — | — | 89.735 | 86.7 | 4.62 | 1.54 |
| Example 49 | 6.0 | 2.0 | 1.3 | 0.75 | 0.2 | 0.020 | — | — | — | 89.73 | 65.0 | 4.62 | 1.54 |
| Example 50 | 6.0 | 2.0 | 1.3 | 0.75 | 0.2 | 0.040 | — | — | — | 89.71 | 32.5 | 4.62 | 1.54 |
| Example 51 | 6.0 | 2.0 | 1.3 | 1.2 | 0.2 | 0.011 | — | — | — | 89.289 | 118.2 | 4.62 | 1.54 |
| Example 52 | 6.0 | 2.0 | 1.3 | 1.5 | 0.2 | 0.011 | — | — | — | 88.989 | 118.2 | 4.62 | 1.54 |
| Comparative Example 1 | 3.0 | 2.0 | 1.3 | 0.75 | 0.2 | 0.011 | — | — | — | 92.739 | — | — | — |
| Comparative Example 2 | 12.0 | 2.0 | 1.3 | 0.75 | 0.2 | 0.011 | — | — | — | 83.739 | — | — | — |
| Comparative Example 3 | 6.0 | 1.0 | 1.3 | 0.75 | 0.2 | 0.011 | — | — | — | 90.239 | — | — | — |
| Comparative Example 4 | 6.0 | 3.0 | 1.3 | 0.75 | 0.2 | 0.011 | — | — | — | 88.239 | — | — | — |
| Comparative Example 5 | 6.0 | 3.5 | 1.3 | 0.75 | 0.2 | 0.011 | — | — | — | 87.739 | — | — | — |
| Comparative Example 6 | 6.0 | 2.0 | 0.2 | 0.75 | 0.2 | 0.011 | — | — | — | 90.339 | — | — | — |
| Comparative Example 7 | 6.0 | 2.0 | 0.3 | 0.75 | 0.2 | 0.011 | — | — | — | 90.239 | — | — | — |
| Comparative Example 8 | 6.0 | 2.0 | 0.5 | 0.75 | 0.2 | 0.011 | — | — | — | 90.039 | — | — | — |
| Comparative Example 9 | 6.0 | 2.0 | 3.0 | 0.75 | 0.2 | 0.011 | — | — | — | 87.539 | — | — | — |
| Comparative Example 10 | 6.0 | 2.0 | 1.3 | 2.00 | 0.2 | 0.011 | — | — | — | 87.989 | — | — | — |
| Comparative Example 11 | 6.0 | 2.0 | 1.3 | 0.20 | 0.2 | 0.011 | — | — | — | 89.789 | — | — | — |
| Comparative Example 12 | 6.0 | 2.0 | 1.3 | 0.75 | 0.01 | 0.011 | — | — | — | 89.429 | — | — | — |
| Comparative Example 13 | 6.0 | 2.0 | 1.3 | 0.75 | 0.8 | 0.011 | — | — | — | 88.639 | — | — | — |
| Comparative Example 14 | 6.0 | 2.0 | 1.3 | 0.75 | 0.2 | 0.003 | — | — | — | 89.247 | — | — | — |
| Comparative Example 15 | 6.0 | 2.0 | 1.3 | 0.75 | 0.2 | 0.005 | — | — | — | 89.245 | — | — | — |
| Comparative Example 16 | 6.0 | 2.0 | 1.3 | 0.75 | 0.2 | 0.10 | — | — | — | 89.15 | — | — | — |
| Comparative Example 17 | 6.0 | 2.0 | 1.3 | 0.75 | 0.2 | 0.011 | 0.25 | — | — | 88.989 | — | — | — |
| Comparative Example 18 | 6.0 | 2.0 | 1.3 | 0.75 | 0.2 | 0.011 | — | 0.20 | — | 89.039 | — | — | — |
| Comparative Example 19 | 6.0 | 2.0 | 1.3 | 0.75 | 0.2 | 0.011 | — | — | 0.20 | 89.039 | — | — | — |

Note:

Each composition in Table 1 is in percentage by weight, and the total weight of impurity elements in the inevitable impurities and aluminum is less than 0.2%.

TABLE 2

| | Tensile strength | Standard deviation of tensile strength | Elongation | Die-casting formability |
|---|---|---|---|---|
| Example 1 | 380 | 6 | 9 | Excellent |
| Example 2 | 380 | 7 | 8.5 | Excellent |
| Example 3 | 355 | 6 | 9 | Excellent |
| Example 4 | 360 | 6 | 9 | Excellent |
| Example 5 | 365 | 6 | 8.5 | Excellent |
| Example 6 | 350 | 7 | 5 | Good |

TABLE 2-continued

| | Tensile strength | Standard deviation of tensile strength | Elongation | Die-casting formability |
|---|---|---|---|---|
| Example 7 | 380 | 9 | 4 | Good |
| Example 8 | 355 | 8 | 4.5 | Good |
| Example 9 | 355 | 8.5 | 4.5 | Good |
| Example 10 | 375 | 6 | 8.5 | Excellent |
| Example 11 | 370 | 6 | 9 | Excellent |
| Example 12 | 380 | 7.1 | 8 | Excellent |

TABLE 2-continued

| | Tensile strength | Standard deviation of tensile strength | Elongation | Die-casting formability |
|---|---|---|---|---|
| Example 13 | 382 | 7.5 | 8 | Excellent |
| Example 14 | 385 | 7.5 | 7 | Excellent |
| Example 15 | 370 | 7 | 8.5 | Excellent |
| Example 16 | 350 | 7 | 8 | Good |
| Example 17 | 370 | 8 | 8 | Good |
| Example 18 | 375 | 8 | 6 | Good |
| Example 19 | 375 | 8 | 5 | Good |
| Example 20 | 370 | 7 | 5.5 | Good |
| Example 21 | 370 | 7 | 4 | Good |
| Example 22 | 385 | 6.5 | 6.5 | Excellent |
| Example 23 | 380 | 7.5 | 6 | Excellent |
| Example 24 | 380 | 7.5 | 7.5 | Excellent |
| Example 25 | 380 | 7.5 | 6.5 | Excellent |
| Example 26 | 385 | 7.5 | 6.5 | Excellent |
| Example 27 | 385 | 7.5 | 6.5 | Excellent |
| Example 28 | 385 | 7 | 6.5 | Excellent |
| Example 29 | 380 | 8 | 4 | Good |
| Example 30 | 370 | 8 | 4 | Good |
| Example 31 | 370 | 8 | 4 | Good |
| Example 32 | 370 | 8 | 4 | Good |
| Example 33 | 385 | 7 | 6.5 | Excellent |
| Example 34 | 375 | 7 | 6 | Excellent |
| Example 35 | 380 | 7 | 6 | Excellent |
| Example 36 | 380 | 7 | 6 | Excellent |
| Example 37 | 370 | 9 | 4.5 | Good |
| Example 38 | 375 | 9 | 4 | Good |
| Example 39 | 380 | 7 | 5 | Good |
| Example 40 | 380 | 7 | 4.5 | Good |
| Example 41 | 380 | 7 | 4 | Good |
| Example 42 | 380 | 6 | 8 | Excellent |
| Example 43 | 365 | 6.5 | 8 | Excellent |
| Example 44 | 375 | 6.5 | 8 | Excellent |
| Example 45 | 365 | 6.5 | 8 | Excellent |
| Example 46 | 375 | 6.5 | 8 | Excellent |
| Example 47 | 370 | 6.5 | 8 | Excellent |
| Example 48 | 370 | 6 | 8 | Excellent |
| Example 49 | 375 | 6 | 8 | Excellent |
| Example 50 | 365 | 7 | 5 | Good |
| Example 51 | 365 | 7 | 6 | Good |
| Example 52 | 365 | 7 | 5 | Good |
| Comparative Example 1 | 230 | 27 | 10 | Poor |
| Comparative Example 2 | 400 | 35 | 2 | Poor |
| Comparative Example 3 | 230 | 17 | 10 | Poor |
| Comparative Example 4 | 280 | 25 | 3 | Poor |
| Comparative Example 5 | 280 | 30 | 2 | Poor |
| Comparative Example 6 | 270 | 25 | 2 | Poor |
| Comparative Example 7 | 270 | 25 | 3 | Poor |
| Comparative Example 8 | 270 | 20 | 3 | Poor |
| Comparative Example 9 | 290 | 30 | 1 | Poor |
| Comparative Example 10 | 240 | 35 | 2 | Poor |
| Comparative Example 11 | 220 | 35 | 4 | Poor |
| Comparative Example 12 | 270 | 20 | 2 | Poor |
| Comparative Example 13 | 230 | 20 | 3 | Poor |
| Comparative Example 14 | 270 | 30 | 3 | Poor |
| Comparative Example 15 | 280 | 25 | 3 | Poor |
| Comparative Example 16 | 275 | 15 | 4 | Poor |
| Comparative Example 17 | 350 | 30 | 2 | Poor |
| Comparative Example 18 | 345 | 25 | 3 | Poor |
| Comparative Example 19 | 345 | 23 | 3 | Poor |

It can be learned from Table 2 that the die-cast aluminum alloy of this disclosure has good mechanical properties (toughness), stability, and die-casting formability.

The preferred implementations of this disclosure are described in detail above, but this disclosure is not limited to the specific details in the foregoing implementations. Various simple variations may be made to the technical solutions of this disclosure within the scope of the technical idea of this disclosure, and such simple variations shall all fall within the protection scope of this disclosure.

It should be further noted that the specific technical features described in the foregoing specific implementations may be combined in any suitable manner without contradiction. To avoid unnecessary repetition, various possible combinations are not further described in this disclosure.

In addition, various different implementations of this disclosure may alternatively be combined randomly. Such combinations should also be considered as the content disclosed in this disclosure provided that these combinations do not depart from the concept of this disclosure.

In the descriptions of this specification, descriptions using reference terms "an embodiment", "some embodiments", "an example", "a specific example", or "some examples" mean that specific characteristics, structures, materials, or features described with reference to the embodiment or example are included in at least one embodiment or example of this disclosure. In this specification, schematic representations of the foregoing terms are not necessarily directed to the same embodiment or example. Moreover, the specific features, structures, materials, or characteristics described may be combined in any one or more embodiments or examples in a suitable manner. In addition, different embodiments or examples described in this specification, as well as features of different embodiments or examples, may be integrated and combined by a person skilled in the art without contradicting each other.

Although the embodiments of this disclosure have been shown and described above, it can be understood that, the foregoing embodiments are exemplary and cannot be understood as limitation to this disclosure. A person of ordinary skill in the art can make changes, modifications, replacements, or variations to the foregoing embodiments within the scope of this disclosure.

What is claimed is:

1. A die-cast aluminum alloy, consisting of:

4-9 wt % of Mg;

1.6-2.8 wt % of Si;

1.1-2 wt % of Zn;

0.5-1.5 wt % of Mn;

0.1-0.3 wt % of Ti;

0.009-0.05 wt % of Be;

the balance of Al; and less than 0.2 wt % of inevitable impurities, wherein in the die-cast aluminum alloy the mass ratio of Me to Zn is (4.5-5):1 and the mass ratio of Si to Zn is (1.5-2):1.

2. The die-cast aluminum alloy according to claim 1, consisting of:

5-7 wt % of Mg;

1.6-2.5 wt % of Si;

1.1-1.4 wt % of Zn;

0.6-1.0 wt % of Mn;

0.1-0.3 wt % of Ti;

0.01-0.022 wt % of Be;

the balance of Al; and less than 0.2 wt % of inevitable impurities.

3. The die-cast aluminum alloy according to claim 1, wherein in the die-cast aluminum alloy, the mass ratio of Zn to Be is (60-140):1.

4. The die-cast aluminum alloy according to claim 1, wherein for the die-cast aluminum alloy, the tensile strength is not less than 350 MPa, the elongation is not less than 4%, and the relative standard deviation of the tensile strength is not greater than 10%.

5. The die-cast aluminum alloy according to claim 1, wherein for the die-cast aluminum alloy, the tensile strength is 350-390 MPa, the elongation is 6-9%, and the relative standard deviation of the tensile strength is 5-8%.

6. The die-cast aluminum alloy according to claim 1, wherein the die-cast aluminum alloy is used in computers, communication electronic products, or consumer electronic products.

7. A die-cast aluminum alloy, consisting of:

5-7 wt % of Mg;

1.6-2.5 wt % of Si;

1.1-1.4 wt % of Zn;

0.7 wt % of Mn;

0.1-0.3 wt % of Ti;

0.01-0.022 wt % of Be;

the balance of Al; and less than 0.2 wt % of inevitable impurities, wherein in the die-cast aluminum alloy, the mass ratio of Me to Zn is (4.5-5):1, and the mass ratio of Si to Zn is (1.5-2):1.

8. A method for preparing the die-cast aluminum alloy according to claim 1, comprising:

smelting an aluminum-containing material in a smelting furnace, adding a silicon-containing material, a manganese-containing material, a zinc-containing material, a magnesium-containing material, a beryllium-containing material, and a titanium-containing material for smelting after the aluminum-containing material is melted, subjecting the mixed materials to refining and degassing and then casting to obtain an aluminum alloy ingot, and melting and die-casting the aluminum alloy ingot, to obtain the die-cast aluminum alloy.

9. The method according to claim 8, wherein a smelting temperature of the aluminum-containing material is 710-730° C., and a smelting temperature of the silicon-containing material, the manganese-containing material, the zinc-containing material, the magnesium-containing material, the beryllium-containing material, and the titanium-containing material is 680-710° C.

* * * * *